United States Patent [19]

Isaia

[11] 4,072,332

[45] Feb. 7, 1978

[54] DOOR LATCH HAVING OVERCENTER SPRING

[75] Inventor: Robert L. Isaia, Roanoke, Ill.

[73] Assignee: Caterpillar Tractor Co., Peoria, Ill.

[21] Appl. No.: 706,717

[22] Filed: July 19, 1976

[51] Int. Cl.[2] ..... E05C 3/04

[52] U.S. Cl. ..... 292/228

[58] Field of Search ..... 292/DIG. 31, DIG. 49, 292/228, 78, 79

[56] References Cited

U.S. PATENT DOCUMENTS

| | | | |
|---|---|---|---|
| 1,269,467 | 6/1918 | Leonard et al. | 292/228 X |
| 2,304,144 | 12/1942 | Borchers | 292/DIG. 31 |
| 2,621,952 | 12/1952 | Gander | 292/DIG. 31 |
| 3,659,886 | 5/1972 | Andrews | 292/DIG. 49 |
| 3,836,185 | 9/1974 | Touchstone | 292/DIG. 49 |

FOREIGN PATENT DOCUMENTS

| | | | |
|---|---|---|---|
| 274,497 | 12/1927 | United Kingdom | 292/DIG. 49 |

*Primary Examiner*—Richard E. Moore

*Attorney, Agent, or Firm*—Wegner, Stellman, McCord, Wiles & Wood

[57] ABSTRACT

A latching mechanism is provided for a service panel for gaining access into a closed compartment. The latch is an all seasons latch such that it can be operated even with an arctic mitten on the hand of the operator. The latch handle is positioned in a recess to prevent accidental actuation. A spring is provided for holding the panel or door latched closed and upon movement of the latch handle past a center position will locate the spring for holding the latch inactive as the door or panel is opened.

8 Claims, 3 Drawing Figures

DOOR LATCH HAVING OVERCENTER SPRING

BACKGROUND OF THE INVENTION

1. Field of the Invention

This invention relates to latching mechanisms and, more particularly, to an overcenter type spring actuated latch for use on a door or on a service panel.

2. Description of the Prior Art

Latch mechanisms for doors or service panels, such as a service panel on a bulldozer-type vehicle, have traditionally been rather simple and, as a result, rather unreliable or difficult to operate. For instance, one type of latch is a cam-shaped disc carried by a pivoted rod, such that turning the rod by means of a screwdriver or the like, will latch the panel closed. Another type latch is a spring actuated keeper which snaps in behind the frame surrounding the panel. To release the panel, the keeper is urged to a position to clear the frame whereby the panel can be opened. And still a further type latch is the flush ring-type, wherein the release actuator member is in a ring shape and is nested in a mating opening in the panel. The ring is dug out of the mating opening and is rotated to release the latch holding the panel closed.

The above examples of the prior art and other similar latch arrangements generally require that the operator have a tool (such as a screwdriver), must be bare-handed to operate and/or the door or panel must be slammed or the latch must be turned to latch the door or panel closed, all of which render the latch less than effective and/or desirable.

SUMMARY OF THE INVENTION

A latching arrangement for a door or panel is provided for closing an opening into a compartment. An example would be a latch on the service panel door permitting access into the engine compartment of a bulldozer-type vehicle. A recess is formed in the door or panel in which recess is located a handle for actuating the latching mechanism. The handle is connected to a shaped element, one part of which serves as the catch member for engaging the inside of the frame of the compartment, and which shaped element supports one end of a tension loaded spring, the other end of which spring is mounted on the support walls carried by the face of the panel.

A pivot is provided between the support walls and the shaped element about which the shaped element moves. A fixed centerline is provided between the pivot axis of the shaped element and the remote mounting for the fixed end of the spring. Movement of the handle will move the one end of the spring from one side of said fixed centerline to the opposite side of said fixed centerline. As the handle is moved from the recess in the panel to a position for releasing the latch from the frame of the compartment, the spring passes over said fixed centerline whereupon the spring serves to hold the latch in the disengaged position. To close the panel over the opening into the compartment, the handle is moved toward the recess in the side of the panel whereupon once the spring passes beyond said fixed centerline, it will snap the handle back into the recess and latch the door or panel relative to the frame of the compartment.

The latching arrangement is positive in function, both in the latched condition and in the unlatched condition, such that unless the handle is moved, the latch will remain either latched or unlatched and the only way the condition can be reversed is by positive movement of the handle.

The recess mounting of the handle keeps the handle out of the main stream of activity so that it is not likely to be accidentally engaged, thereby unlatching the panel. The recess and shape of the handle is such that on operator can actuate the latch for opening the panel without removing his gloves. Even an operator wearing an arctic mitten is able to engage the handle and latch or unlatch the panel.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
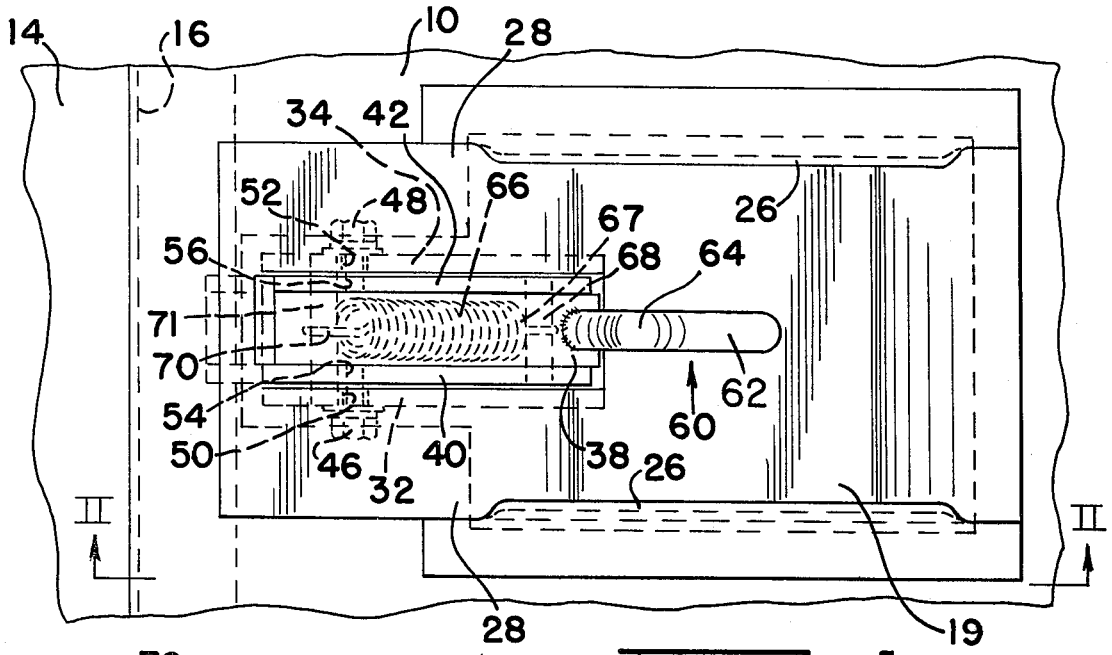
FIG. 1 is a front elevational view of my improved panel latching arrangement.

Referring to the drawings wherein like reference numerals refer to like parts throughout, a door or service panel 10 has a hinge 12 connected to a housing 14, which housing 14 has an opening 16 covered by said door or service panel 10. The housing 14 is generally the cover or cowling which defines a compartment 17, which compartment can contain a battery, an engine or some other piece of equipment or apparatus carried either by a land, air or water vehicle, a stationary piece of equipment, or the like. For illustration purposes, the present invention is described as being applied to a service panel 10 for closing an opening 16 in the sheet metal housing 14 enclosing an engine of a bulldozer-type vehicle, such that when the service panel 10 is open, access is permitted to the engine. As illustrated, a resilient sealing strip 18 is carried by the housing 14 along the edge of the opening 16, which strip 18 is adapted to be engaged by a projecting portion of the door or service panel 10.

The panel 10 has a recessed portion 19 defined by a cup-shaped or pan-shaped member 20 which is secured in a cutout portion 22 formed in the body of the service panel 10. The pan-shaped member 20 has lip portions 24 which are secured to the outer face of the panel 10 fore and aft of the cutout 22. The cutout 22 has inwardly projecting narrow tongue-like elements 26 which overlap the side walls 28 of the pan 20 and are turned down into the recess 19 in the pan 20 so as to hold the pan in position relative to the panel 10. Welded or otherwise secured to the inner surface of the panel 10 are a pair of inwardly projecting, spaced apart, substantially parallel plates 32 and 34. The plates 32,34 are secured to the sloping wall of the pan 20 and have a cross bar 35 extending between said plates.

A latch member 36 has a cylindrically shaped portion 38 and a pair of parallel, spaced apart side walls 40 and 42. A base portion 44 extends between said walls 40,42 and joins with one end of said cylindrically shaped portion 38. The end portion of said base 44 remote from said cylindrical portion 38 serves as the latching surface for engaging the inside surface of the housing 14 for holding the panel in the latched position. A pair of aligned pivot pins 46,48 pass through aligned openings 50,52 in the parallel plates 32,34 carried by the panel and into aligned openings 54,56 in the walls 40,42 of the latch member 36. The pivot pins 46,48 are such as to permit the latch member 36 to pivot about the axis of said pins within the open space between the parallel plates 32,34 and with the center of the cylindrical portion 38 being on the axis of said pins 46,48.

The latch member 36 has a handle or actuating lever 60, rigidly connected as by welding or the like to the midportion thereof at the junction between the cylindrical portion 38 and the base portion 44 thereof. The handle 60 has an elongate gripping portion 62 which is angularly disposed to an attaching portion 64 which in turn is welded to the junction between the cylindrical member 38 and the base 44. The gripping portion 62 is positioned within the recess 19 formed by the pan 20 so that it does not project beyond the plane forming the outer surface of the panel 10, when the handle is in the latched position. Likewise, the sides and projecting ends of the gripping portion 62 are spaced from the pan 20 so as not to pinch the fingers or hands of an operator as the handle 60 is moved into latching position.

A coil spring 66 has one end portion 67 connected to a cross pin 68 extending between the side walls 40,42 of the latch member 36 with the axis of the cross pin 68 lying generally in line with one part of the attaching portion 64 of the handle 60. The spring 66 is placed under tension and has the other end portion 70 connected to a cross pin 71 extending between the fixed plates 32,34. The axes of the pivot pins 46,48 and the axis of the cross pin 71 passing through the fixed plates 32,34 are fixed relative to each other and locate a centerline 72 which passes through the centers of said pins 46,48 and 71. The latch member 36, as it pivots about the pivot pins 46,48, moves the centerline 75 of the spring 66 from one side of the fixed centerline 72 passing through the pivot pin 71 and the pivot pins 46,48 to the other side of said centerline 72. As the centerline 75 of the spring 66 is moved past the fixed centerline 72, it is considered to have passed over center and, once over center, the spring will hold the latch member 36 against either the side or the end of the bar 35.

Figure 2:
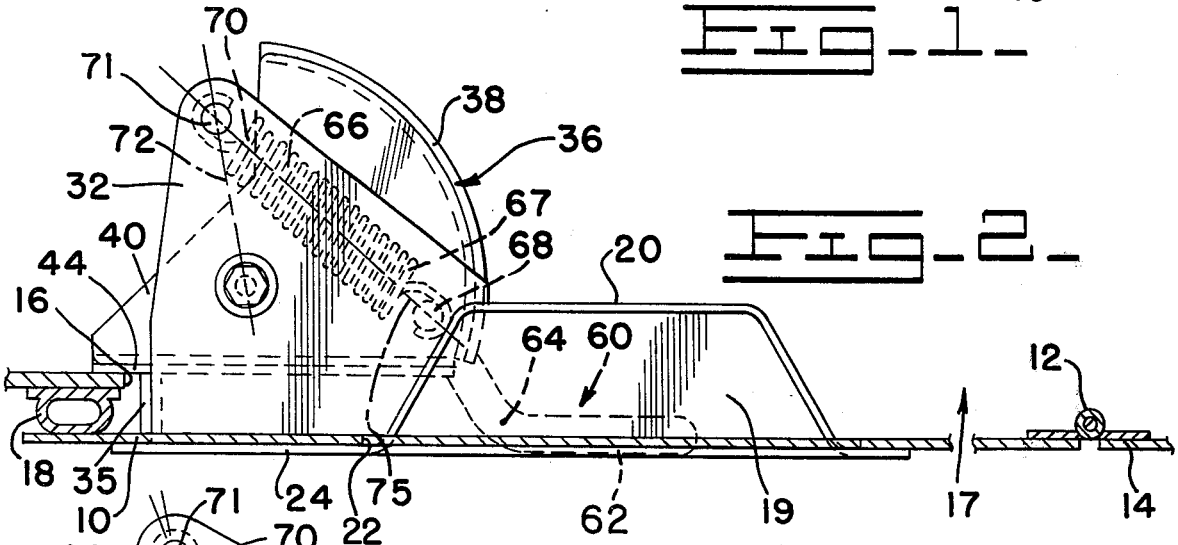
FIG. 2 is a cross-sectional view taken along the lines 2—2 of FIG. 1.
Figure 3:
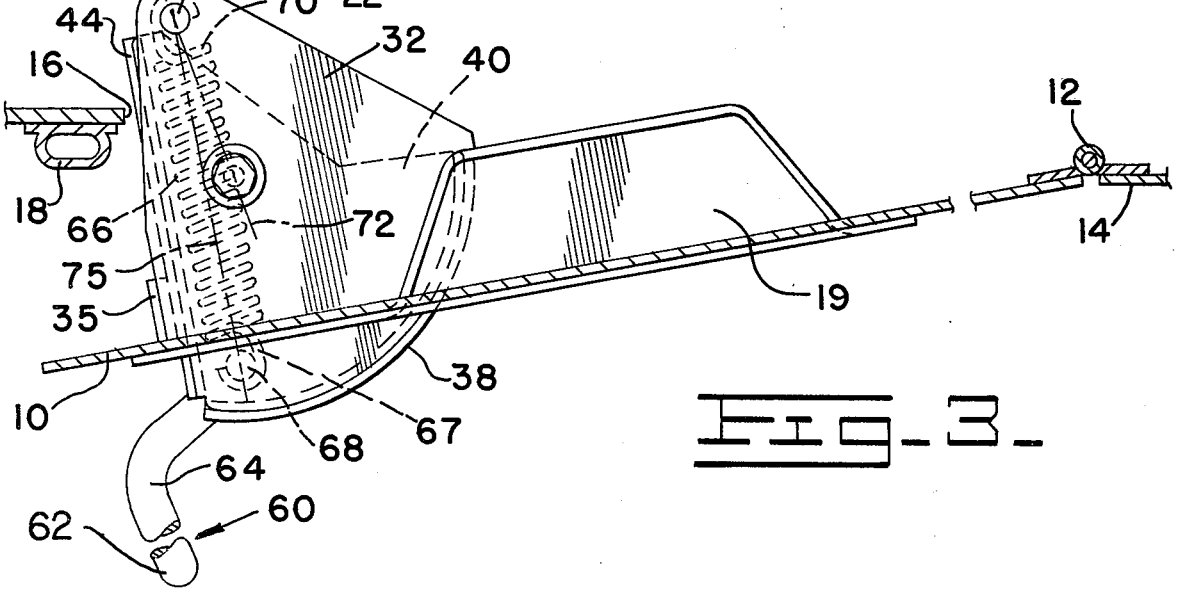
FIG. 3 is the same view as FIG. 2, only with the latch in the disengaged position.

Specifically, with the handle 60 in position in the recess 19, the panel 10 is latched relative to the housing 14 with the centerline 75 of the spring 66 lying on the right side of the fixed centerline 72. The base 44 of the latch member 36 engages both the inside of the housing 14 and the end of the bar 35 as the sealing strip 18 is compressed between the panel edge and the housing. Grasping the handle 60 and moving it clockwise as viewed from above and as shown in FIG. 2 will move the centerline 75 of the spring 66 closer to the fixed centerline 72. Once the centerline 75 of the spring passes in the clockwise direction beyond the centerline 72 between the pivots 46,48 and pin 71, the spring will take over and pull the latch member 36 clockwise until the base 44 engages the side of the stop bar 35. In this position, the latch portion of the base 44 of the latch member 36 is out of alignment with the edge of the housing so that the panel 10 can be pivoted about the hinge 12 permitting access into the compartment 17.

To close the panel 10 over the opening in the housing 14, the handle 60 is grasped and the panel is urged against the resilient strip 18. The handle 60 is then pivoted counterclockwise until the centerline 75 of the spring 66 passes to the right of the fixed centerline 72 between the pivots 46,48 and the pin 71 whereupon the tension of the spring will continue to pivot the latch member 36 and the handle 60 in a counterclockwise direction until the latch portion of the base 44 engages behind the edge of the housing as the handle 60 moves into the recess 19 in the panel. When the latch member 36 engages the outer end of the cross bar 35 on the inside of the panel, the door or panel will be latched to the housing and the handle will be positioned in the recess in the pan 20 out of alignment with the plane of the outer surface of the panel.

The spacing between the gripping portion 62 of the handle 60 and the bottom and the remote wall of the recess 19 is such that an operator wearing the largest available glove or mitten, for instance, an arctic mitten, can thrust his gloved hand between the handle and the walls of the recess and can lift the handle 60 for releasing the latch and opening the panel. For closing the panel, the same gloved hand can grasp and pivot the handle 60 in a counterclockwise direction until the centerline 75 of the spring 66 passes beyond the fixed centerline 72 whereupon the spring will take over and return the handle to the recess 19 and will pivot the latch member behind the edge of the compartment wall, thereby latching the panel relative to the housing. Another advantage to the overcenter concept of the latch arrangement is the fact that not more than a quarter turn of the handle is required to disengage the latching arrangement, and even a less movement is required to effect latching of the arrangement. The latching arrangement is positive and effective, with the spring holding the latch either in disengaged or in engaged position.

I claim:

1. In a latch arrangement for securing a panel over an opening in a housing, said panel being hinged to said housing and having a pair of plates projecting inwardly toward the inside of said housing, latch means pivotally mounted about an axis extending between said plates, a projecting portion of said latch means extending from said panel and being adapted to engage an inside wall of said housing to secure said panel over said opening, said latch means is comprised of a pair of spaced walls joined together by a cylindrically-shaped portion having a center on said axis of said pivotal mounting of said latch means, and a base extending between said spaced walls with one end thereof forming said projecting portion, a handle carried by said latch means and extending to a position exterior of said panel, a spring connected at one end to said latch means and connecting at the other end to said plates, said other end of said spring and said axis about which said latch means pivots lying along a fixed axis, movement of said handle pivots said latch means and said spring to shift said spring from a position on one side of said fixed axis to the other side thereof, whereby clockwise movement of said handle and said latch means moves the one end of said spring beyond said fixed axis whereupon the projecting portion of the latch means is disengaged from the inside of said housing and whereby movement of said handle in a counterclockwise direction will move the spring back beyond said fixed axis for positioning said projecting portion of said latch means against the inside wall of said housing for holding the panel latched over the opening into said housing.

2. A latch arrangement for securing a hinged panel closed over an opening in a housing, a pair of plates carried by the panel, latch means mounted on a pair of aligned pivots extending from said plates for pivotal movement about an axis of said pivots extending between said plates, contact means on said latch means adapted to engage an inside wall of said housing for securing said panel closed over said opening, a handle carried by said latch means and projecting to a position exterior of said panel, a spring connected at one end to said latch means and connecting at the other end to a pin extending between said pair of plates, the axis of said spring substantially lines up with said handle, said other end of said spring and said axis about which said latch means pivots lying along a fixed axis, said spring having a centerline shiftable from a position on one side of said fixed axis to the other side thereof, whereby moving said handle will pivot said latch means and move the one end of said spring from one side of said fixed axis for disengaging said contact means from engagement with said housing to the other side of said fixed axis for engaging said contact means against the inside of said housing for holding the panel latched over the opening into said housing.

3. In a latch arrangement for securing a panel over an opening in a housing, said panel being hinged to said housing and having a pair of plates projecting inwardly toward the inside of said housing, latch means pivotally mounted about an axis of a pair of aligned pivots extending from said plates, a projecting portion of said latch means extending from said panel and being adapted to engage an inside wall of said housing to secure said panel over said opening, a handle carried by said latch means and extending to a position exterior of said panel, a spring connected to one end to said latch means and connected at the other end to a pin extending between said pair of plates, said axis of said spring substantially lines up with said handle, said other end of said spring and said axis about which said latch means pivots lying along a fixed axis, movement of said handle pivots said latch means and said spring to shift said spring from a position on one side of said fixed axis to the other side thereof, whereby clockwise movement of said handle and said latch means moves the one end of said spring beyond said fixed axis whereupon the projecting portion of the latch means is disengaged from the inside of said housing and whereby movement of said handle in a counterclockwise direction will move the spring back beyond said fixed axis for positioning said projecting portion of said latch means against the inside wall of said housing for holding the panel latched over the opening into said housing.

4. In the latch arrangement as claimed in claim 2 wherein said panel has a recessed portion in the outer surface thereof and wherein said handle nests in said recess when said contact means is engaged with the wall of the housing.

5. In a latch arrangement as claimed in claim 4 wherein said handle has an outer end spaced from the walls and from the bottom of said recessed portion whereby a relatively thick gloved hand of an operator may be inserted between the handle and the walls and base of the recessed portion for actuating said latch arrangement.

6. A latch arrangement for securing a hinged panel closed over an opening in a housing, a pair of plates carried by the panel, latch means mounted on said plates for pivotal movement about an axis extending between said plates, contact means on said latch means adapted to engage an inside wall of said housing for securing said panel closed over said opening, said latch means is comprised of a pair of spaced walls joined together by a cylindrically-shaped portion having a center on said axis of said pivotal mounting of said latch means, and a base extending between said spaced walls with one end thereof forming said contact means, a handle carried by said latch means and projecting to a position exterior of said panel, a spring connected at one end to said latch means and connecting at the other end to said plates, said other end of said spring and said axis about which said latch means pivots lying along a fixed axis, said spring having a centerline shiftable from a position on one side of said fixed axis to the other side thereof, whereby moving said handle will pivot said latch means and move the one end of said spring from one side of said fixed axis for disengaging said contact means from engagement with said housing to the other side of said fixed axis for engaging said contact means against the inside of said housing for holding the panel latched over the opening into said housing.

7. In the latch arrangement as claimed in claim 1 wherein said panel has a recessed portion in the outer surface thereof and wherein said handle nests in said recess when said latch means is engaged with the inside wall of the housing.

8. In the latch arrangement as claimed in claim 7 wherein said handle has an outer end portion spaced from the walls and from the bottom of said recessed portion whereby a relatively thick gloved hand of an operator may be inserted between the handle and the walls and base of the recessed portion for actuating said latch arrangement.

* * * * *

UNITED STATES PATENT AND TRADEMARK OFFICE

CERTIFICATE OF CORRECTION

PATENT NO. : 4,072,332

DATED : February 7, 1978

INVENTOR(S) : Robert L. Isaia

It is certified that error appears in the above-identified patent and that said Letters Patent are hereby corrected as shown below:

Column 2, line 6, "on" should be --an--.

Column 5, line 32, "to" (first occurrence) should be --at--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*